US008011642B2

(12) United States Patent
Tsai et al.

(10) Patent No.: US 8,011,642 B2
(45) Date of Patent: Sep. 6, 2011

(54) CRUISING AERATOR

(75) Inventors: Ming-Chin Tsai, Yunlin Hsien (TW); Mei-Ling Chen, Yunlin Hsien (TW)

(73) Assignees: Rongfeng Tsai, Yulin Hsien (TW); Mei-Ling Chen, Yulin Hsien (TW)

( * ) Notice: Subject to any disclaimer, the term of this patent is extended or adjusted under 35 U.S.C. 154(b) by 272 days.

(21) Appl. No.: 12/477,930

(22) Filed: Jun. 4, 2009

(65) Prior Publication Data

US 2010/0308478 A1 Dec. 9, 2010

(51) Int. Cl.
*B01F 3/04* (2006.01)

(52) U.S. Cl. ..... 261/91; 210/242.2; 261/120; 415/7; 416/85; 417/61

(58) Field of Classification Search ..... 261/87, 261/91, 93, 120; 210/219, 242.1, 242.2; 415/7; 416/85; 417/61
See application file for complete search history.

(56) References Cited

U.S. PATENT DOCUMENTS

| | | | | | |
|---|---|---|---|---|---|
| 3,794,303 | A * | 2/1974 | Hirshon | ..... | 261/61 |
| 3,865,908 | A * | 2/1975 | Hirshon | ..... | 261/77 |
| 3,865,909 | A * | 2/1975 | Cramer, Jr. | ..... | 261/91 |
| 3,911,065 | A * | 10/1975 | Martin et al. | ..... | 261/91 |
| 4,193,951 | A * | 3/1980 | Stanley | ..... | 261/91 |
| 5,104,589 | A * | 4/1992 | Palmer et al. | ..... | 261/120 |
| 5,185,085 | A * | 2/1993 | Borgren | ..... | 210/747.6 |
| 5,330,639 | A * | 7/1994 | Murphree | ..... | 210/170.05 |
| 5,741,443 | A * | 4/1998 | Gemza | ..... | 261/77 |
| 6,551,053 | B1 * | 4/2003 | Schuetz | ..... | 415/3.1 |
| 2006/0279006 | A1 * | 12/2006 | Tsai | ..... | 261/4 |

FOREIGN PATENT DOCUMENTS

| | | | | | |
|---|---|---|---|---|---|
| CN | 2770349 | Y | | 4/2006 | |
| JP | 4-141300 | A | * | 5/1992 | ..... 210/242.2 |

* cited by examiner

*Primary Examiner* — Richard L Chiesa
(74) *Attorney, Agent, or Firm* — CKC & Partners Co., Ltd.

(57) ABSTRACT

A cruising aerator includes a raft, a motor mounted on the raft, a shaft driven by the motor, a first impeller mounted on the shaft, a second impeller mounted on the shaft, and a common chamber. The cruising aerator further includes a sequential controller connected to the motor for controlling the motor to rotate clockwise or counterclockwise. The motor, the shaft and impellers are installed inside of the common chamber. The common chamber has a common inlet disposed under a water surface. A first outlet and a second outlet of the common chamber are arranged to face in opposite directions. The first impeller and second impeller are assembled to have opposite normal rotating directions to each other according to a rotating direction of the motor.

20 Claims, 8 Drawing Sheets

CRUISING AERATOR

BACKGROUND

1. Field of Invention

The present invention relates to an aerator. More particularly, the present invention relates to a cruising aerator.

2. Description of Related Art

Aquatic pools, fishponds or fishing farms usually requires aeration devices to maintain the concentration of dissolved oxygen (DO), which is absolutely necessary and important to the breathing of aquatics, underwater organisms and microorganisms, the stabilization of water quality, and the ecological equilibrium of pool water. Microorganisms have to absorb dissolved oxygen from water to decompose the redundant organic material and to perform nitrification, which transforms ammonia ($NH_3$) of higher toxicities into nitrous ($NO_2$) or nitric ($NO_3$) acid of much lower toxicities.

A paddlewheel, a typical conventional aeration device, splashes water into the air by its vane wheels driven by a motor, and it increases the aeration time and surface area between the water clusters and air, so as to achieve the purposes of aeration and increasing the dissolved oxygen concentration.

An aerobic treatment pool of a waste water treatment factory of the general environmental protection and the chemical industries also uses microorganisms to decompose the organic materials in the water. In these applications, a blowing machine, an air pipe and air vents are typically used to transport air to the bottom of the pool, at which the air is transformed as a plurality of small air bubbles and liberated at the pool bottom. The mixing of small air bubbles and water increases the concentration of dissolved oxygen of pool water, and, therefore, promotes the decomposition rate of the organic materials by microorganisms.

Although the traditional paddlewheel has been widely used in aquatic pools for a long history, its aeration effect on increasing the concentration of dissolved oxygen is quite small, especially for the region close to the bottom of the pool or those not very close to the paddlewheel. Therefore, aquatic pools of wider areas usually require a number of conventional paddlewheel, which are installed in different locations to increase the concentration of dissolved oxygen (DO) in the pool. However, the power consumption is large due to its poor aeration efficiency, and the capital cost is expensive since a number of paddle wheels are required.

SUMMARY

The invention provides a cruising aerator, which includes a raft, a motor mounted on the raft, a shaft having a first end and a second end driven by the motor, a sequential controller connected to the motor for controlling the motor to rotate clockwise or counterclockwise, a first impeller mounted on the first end of the shaft, a second impeller mounted on the second end of the shaft, and a common chamber. The motor, shaft and impellers are installed inside of the common chamber. The common chamber has a common inlet disposed under a water surface and a first outlet corresponding to the first impeller and a second outlet corresponding to the second impeller. The first impeller and second impeller are assembled to have opposite normal rotating directions to each other according to a rotating direction of the motor. The first outlet and second outlet are arranged to face in opposite directions.

The invention provides a cruising aerator, which includes a raft, a motor mounted on the raft, a shaft driven by the motor, a sequential controller connected to the motor for controlling the motor to rotate clockwise or counterclockwise, a first chamber and impeller, and a second chamber and impeller. The first impeller is installed in the first chamber with a first outlet and a first inlet. The second impeller is installed in the second chamber with a second outlet and a second inlet. The first and second impellers are assembled to have opposite normal rotating directions to each other according to a rotating direction of the motor. The first outlet and the second outlet are arranged to face in opposite directions.

The invention provides a cruising aerator, which includes a raft, a motor mounted on the raft, a sequential controller connected to the motor for controlling the motor to rotate clockwise or counterclockwise, a first shaft driven by the motor, a second shaft disposed under a water surface, a drive chain linking the first shaft and the second shaft, a first impeller and a second impeller mounted on the second shaft. The first impeller is installed in the first chamber with a first outlet and a first inlet. The second impeller is installed in the second chamber with a second outlet and a second inlet. The first and second impellers are assembled to have opposite normal rotating directions to each other according to a rotating direction of the motor. The first outlet and the second outlet are arranged to face in opposite directions.

It is to be understood that all the foregoing general description and the following detailed description are examples, intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
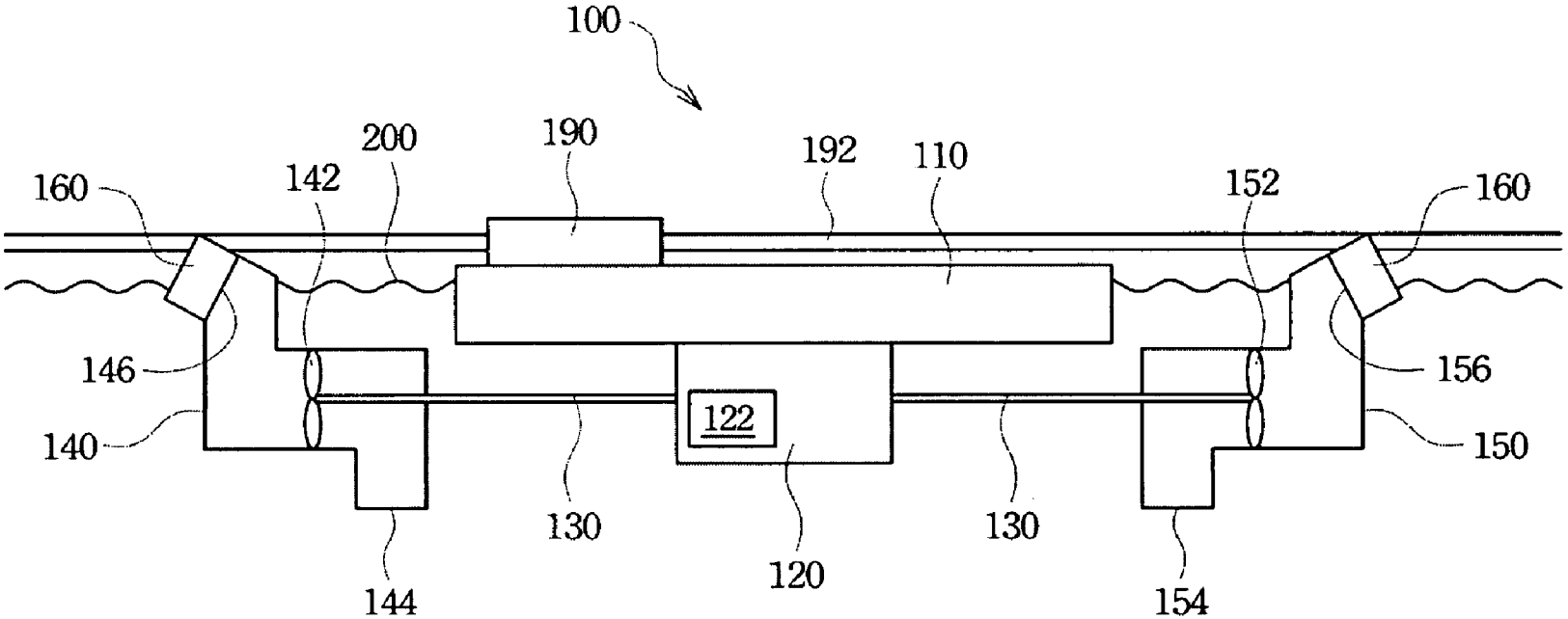
FIG. 1 is a schematic diagram of a first embodiment of the cruising aerator of the invention.

Reference will now be made in detail to the present preferred embodiments of the invention, examples of which are illustrated in the accompanying drawings. Wherever possible, the same reference numbers are used in the drawings and the description to refer to the same or like parts.

Refer to FIG. 1. FIG. 1 illustrates a schematic diagram of a first embodiment of the cruising aerator of the invention. The cruising aerator 100 includes a raft 110, a motor 120 mounted on the raft 110, a shaft 130 driven by the motor 120, a first impeller 142 and a second impeller 152 mounted on the shaft 130, a first chamber 140, and a second chamber 150. The motor 120 of this embodiment is a submerged motor and disposed under the water surface 200.

The shape of the first chamber 140 and the second chamber 150 is similar to an inverted-L. The first chamber 140 has a first inlet 144 and a first outlet 146. The second chamber 150 has a second inlet 154 and a second outlet 156. The first outlet 144 and the second outlet 154 are side openings and are purposely-arranged to face in opposite directions.

The first impeller 142 is mounted on an end of the shaft 130 and is installed in the first chamber 140. The second impeller 152 is mounted on the other end of the shaft 130 and is installed in the second chamber 150. The first impeller 142 and the second impeller 152 are assembled to have opposite normal rotate direction to each other, and are disposed on two opposite sides of the shaft 130. For example, the first impeller 142 is assembled to be normal turn when rotating clockwise, and the second impeller 152 is assembled to be reverse turn when rotating clockwise. Namely, the first impeller 142 would become reverse turn when rotating counterclockwise, and the second impeller 152 would become normal turn when rotating counterclockwise. The first impeller 142 and the second impeller 152 may be an axial impeller, a propeller impeller, a turbine impeller, or a centrifugal impeller. The first chamber 140 associated with the first impeller 142 and the second chamber 150 associated with the second impeller 152 are regarded as pumping devices. It must be noted that pumping devices have greater volumetric and mechanical efficiencies when operating in normal turn than in reverse turn.

When the motor 120 rotates clockwise, the first impeller 142 and the shaft 130 rotate clockwise, which is regarded as normal turn, but the second impeller 152 rotates clockwise would be regarded as reverse turn. The second impeller 152 rotates reversely associated with much less volumetric and mechanical efficiencies in pumping water than the first impeller 142, which rotates normally. Accordingly, water in the deep region, especially close to the pool bottom, is pumped via the first inlet 144, and ejected through the first outlet 146, which is a side opening. The ejected water jets are of much larger flow rates and stronger momentum than those from the second chamber 150, and generate a counter-force to propel the cruising aerator 100 in the opposite direction. Namely, the cruising aerator 100 can self-move toward the side of the second chamber 150 when the motor 120 rotates clockwise.

When the motor 120 rotates counterclockwise, the first impeller 142 and the shaft 130 rotate counterclockwise and are regarded as reverse turn according to the assembly direction, but the second impeller 152 is regarded as normal turn according to the assembly direction. Consequently, water enters the second chamber 150 via the second inlet 154 and is ejected through the second outlet 156, which is a side opening. By the same principle, water jets ejected from the second outlet 156 generate a counter-force to propel the cruising aerator 100 toward the side of the first chamber 140.

The cruising aerator 100 can employ a sequential controller 122 connected to the motor 120 for controlling the motor 120 to rotate clockwise or counterclockwise so as to form an automatic back-and-forth cruising motion on the water surface 200. The sequential controller 122 can control the direction of rotation and duration of operation of the motor 120, and, therefore, regulates the cruising direction, distance, and power switching duration of the cruising aerator 100. The cruising aerator 100 further includes a guiding device composed of a pipe 190, disposed on the raft 110, and a guiding rope 192, which is set over the water surface 200 and passes through the pipe 190. The route of the cruising aerator 100 in a pool can be changed by altering the locations of guiding rope 192. The limit of the cruising distance is slightly less than twice of the length of the power cable and subject to the length of the rope or pool geometry.

The cruising aerator 100 may be fitted with two aeration nozzles 160 disposed on the first outlet 146 and the second outlet 156. The cruising aerator 100 exploits its important effect by drawing in water from a deep region of low dissolved oxygen (DO) concentration and high concentrations of harmful chemicals ($NH_3$, $CH_4$, $H_2S$ etc.). The water jets are subsequently atomized into a large number of small droplets via the aeration nozzles. The water droplets fly in the air for several seconds to increase DO concentrations and reduce the concentrations of harmful chemicals ($NH_3$, $CH_4$, $H_2S$ etc.). The water droplets finally fall back onto the water surface at distances between 5 and 15 meters away from the aeration nozzle. The atomization increases the aeration efficiency due to the increase in water/air contact surface area by reducing the droplet size, and the duration of droplet suspension in the air, compared with the traditional paddle-wheel. In addition, pumping water from the lower water layer induce a convection flow from the upper to lower water layers.

In summary, the increase in DO and decrease in harmful chemical ($NH_3$, $CH_4$, $H_2S$ etc.) concentrations of water are very helpful to maintain the ecological equilibrium of aquatic pools, and to the health and growth rate of aquatic animals. The cruising aerator 100 has high aeration efficiency since it can operate over a wide area due to the automatic cruising motion, and generate a large number of small water droplets associated with long suspension time in the air, and induce a convection flow from the upper to lower water layers to enhance algae's photosynthesis.

Figure 2:
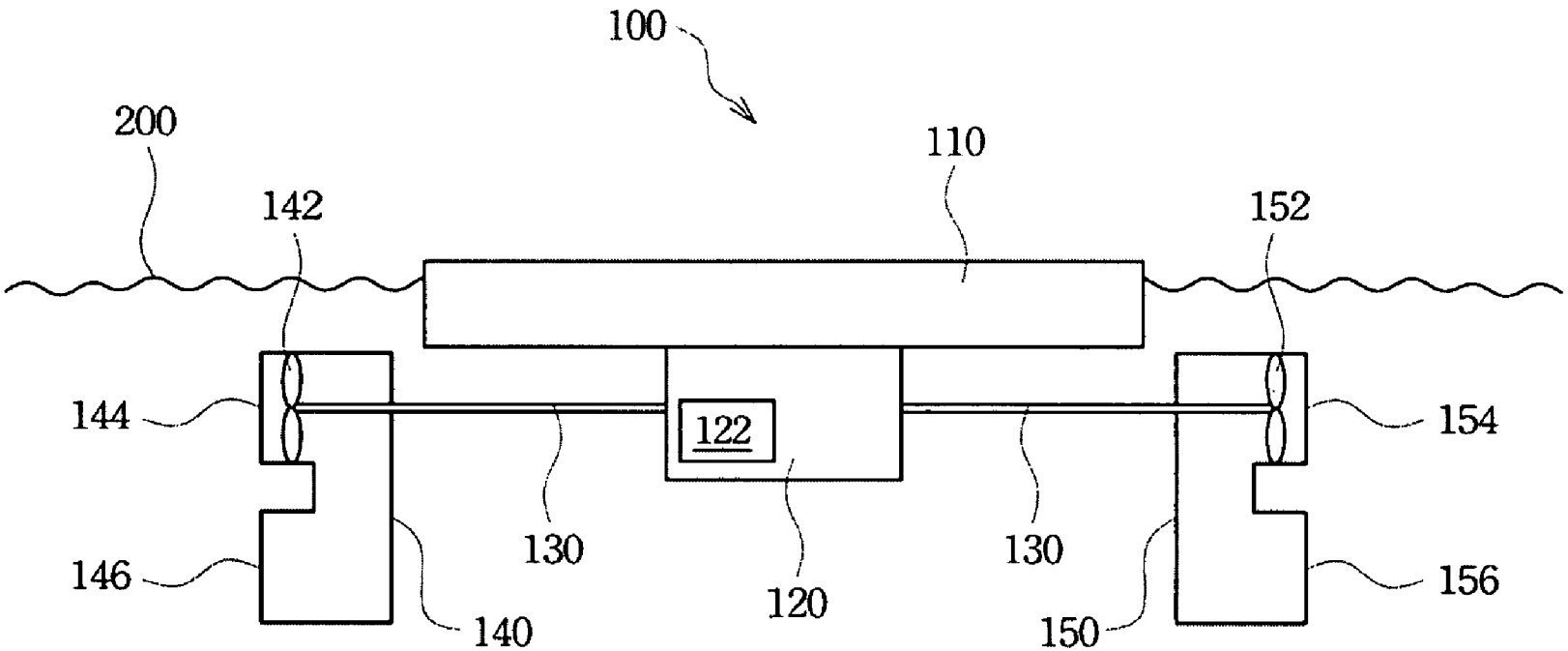
FIG. 2 is a schematic diagram of a second embodiment of the cruising aerator of the invention.

Refer to FIG. 2. FIG. 2 illustrates a schematic diagram of a second embodiment of the cruising aerator of the invention. The cruising aerator 100 includes a raft 110, a motor 120 mounted on the raft 110, a shaft 130 driven by the motor 120, a first impeller 142 and a second impeller 152 mounted on the shaft 130, a first chamber 140, and a second chamber 150. The motor 120 of this embodiment is a submerged motor and disposed under the water surface 200.

The shapes of the first chamber 140 and the second chamber 150 can be similar to a lain-U. The first inlet 144, the first outlet 146, the second inlet 154, and the second outlet 156 are side openings. The first outlet 146 and the second outlet 156 are purposely-arranged to face in opposite directions.

The first impeller 142 and the second impeller 152 can be an axial impeller, a propeller impeller, a turbine impeller, or a centrifugal impeller. The first impeller 142 and the second impeller 152 rotate in opposite directions to each other. The first chamber 140 associated with the first impeller 142 and the second chamber 150 associated with the second impeller 152 are regarded as pumping devices. It must be noted that pumping devices have greater volumetric and mechanical efficiencies when operating in a normal turn than in reverse turn.

The assembly of the first impeller 142 and the second impeller 152 is purposely-designed according to the first inlet 144 and the second inlet 154. The first inlet 144 and the second inlet 154 are arranged close to the water surface 200, to pump water of high DO concentration due to algae's photosynthesis. The first outlet 146 and the second outlet 156 are purposely-arranged close to the pool bottom or far from the water surface 200. Accordingly, the cruising aerator 100 can pump water flow of high DO concentration into deep region of the pool associated with low DO and high harmful chemical ($NH_3$, $CH_4$, $H_2S$ etc.) concentrations, and form a forced-convection flow from upper to lower water layers.

When the motor 120 rotates clockwise, the first impeller 142 and the shaft 130 rotate clockwise, which is regarded as normal turn according to the assembly direction, but the second impeller 152 rotates clockwise would be regarded as reverse turn according to the assembly direction. Accordingly, water enters the first chamber 140 via the first inlet 144 and is ejected through the first outlet 146, which is a side opening. The water jets ejected from the first outlet 146 are of large flow rates and strong momentum, and generate a large counter-force to propel the cruising aerator 100 in the opposite direction.

Namely, the cruising aerator 100 can self-move toward the side of the second chamber 150 when the motor 120 rotates clockwise.

When the motor 120 rotates counterclockwise, the first impeller 142 and the shaft 130 rotate counterclockwise, which is regarded as reverse turn according to the assembly direction, but the second impeller 152 is regarded normal turn according to the assembly direction. By the same principle, the water jets ejected from the second outlet 156 generate a large counter-force to propel the cruising aerator 100 toward the side of the first chamber 140.

The cruising aerator 100 can employ a sequential controller 122 for controlling the motor 120 to rotate clockwise or counterclockwise together with a guiding device so as to control the cruising aerator 100 cruising back and forth along a predetermined route in a pool.

The first outlet 146 and the second outlet 156 may be optionally fitted with nozzles (not shown) in order to enhance the convection and mixing effects which exists between the upper water layer of high DO concentration and the lower water layer of low DO concentration resulting in an effective increase in DO concentration of low water layer.

In summary, the cruising aerator 100 is of high aeration efficiency for a large pool due to three contributory factors. Firstly, it is suitable for a large pool since it can automatically cruise back-and-forth for a long distance. Secondly, it generates a large water flow rate with less power consumption compared with the paddle-wheel. Thirdly, it generates a forced convection-flow from upper (usually close to water surface) to lower water layers (close the pool bottom), and leads to an enlargement of the working range of algae's photosynthesis. The above effects result in a large increase in DO concentration and decrease in harmful chemical ($NH_3$, $CH_4$, $H_2S$ etc.) concentrations of water in deep region, and are very helpful to maintain water quality, the ecological equilibrium of aquatic pools, and to the health and growth rate of aquatic animals.

Figure 3:
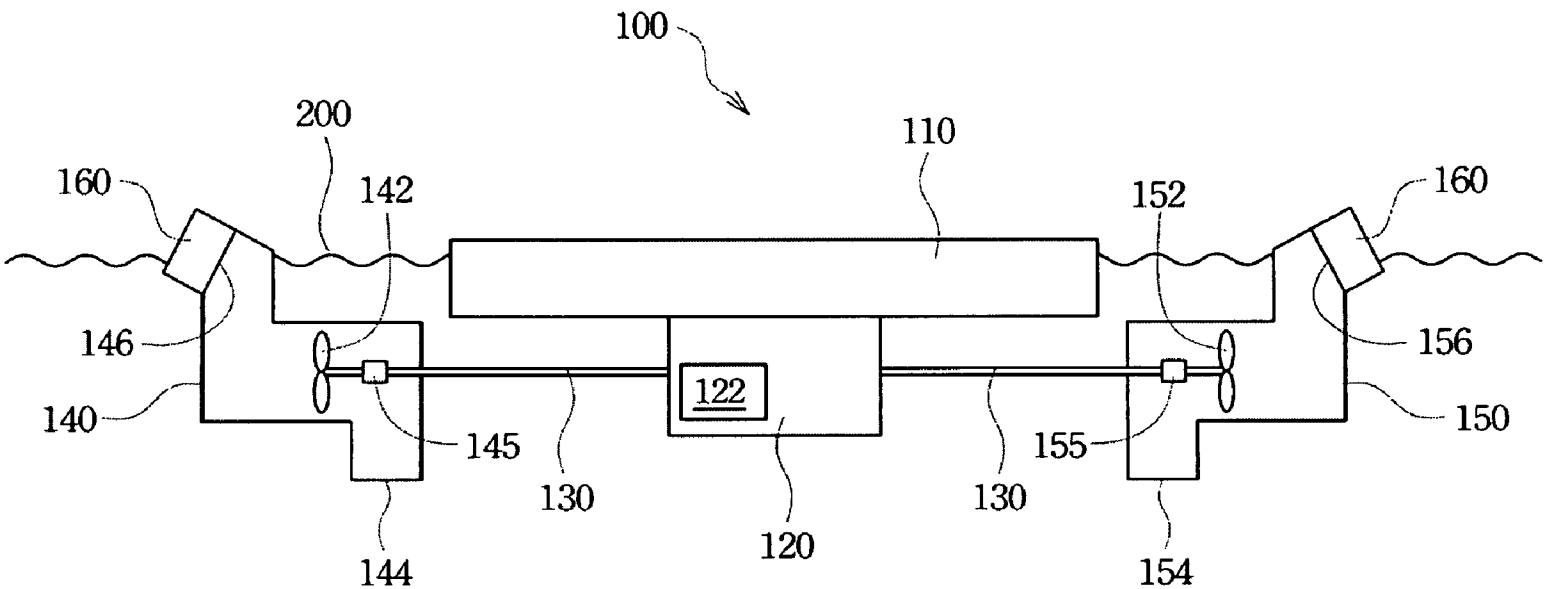
FIG. 3 is a schematic diagram of a third embodiment of the cruising aerator of the invention.

Refer to FIG. 3. FIG. 3 illustrates a schematic diagram of a third embodiment of the cruising aerator of the invention. The cruising aerator 100 further includes the first and second one-way bearings 145 and 155, respectively. The first one-way bearing 145 connects the shaft 130 and the first impeller 142. The second one-way bearing 155 connects the shaft 130 and the second impeller 152. The one-way bearings 145 and 155 rotate in opposite directions.

When the motor 120 rotates clockwise, the shaft 130 and the first one-way bearing 145 and the first impeller 142 are driven to rotate clockwise but the second one-way bearing 155 and the second impeller 152 stay still to reduce power consumption since the second one-way bearing 155 is in opposite rotating direction. Water is pumped into the first chamber 140 via the first inlet 144, and is ejected through the first outlet 146. The ejected water jets are associated with large flow rates and momentum and generate a large counter-force to propel the cruising aerator 100 toward the direction of the second chamber 150.

By the same principle, when the motor 120 rotates counterclockwise, and second one-way bearing 155 and the second impeller 152 are driven to rotate counterclockwise to pump water of large flow rates but the first one-way bearing 145 and the first impeller 142 stay still. Water is pumped into the second chamber 150 via the second inlet 154 and is ejected through the second outlet 156. The ejected water jets generate a counter-force to propel the cruising aerator 100 toward the direction of the first chamber 140.

Figure 4:
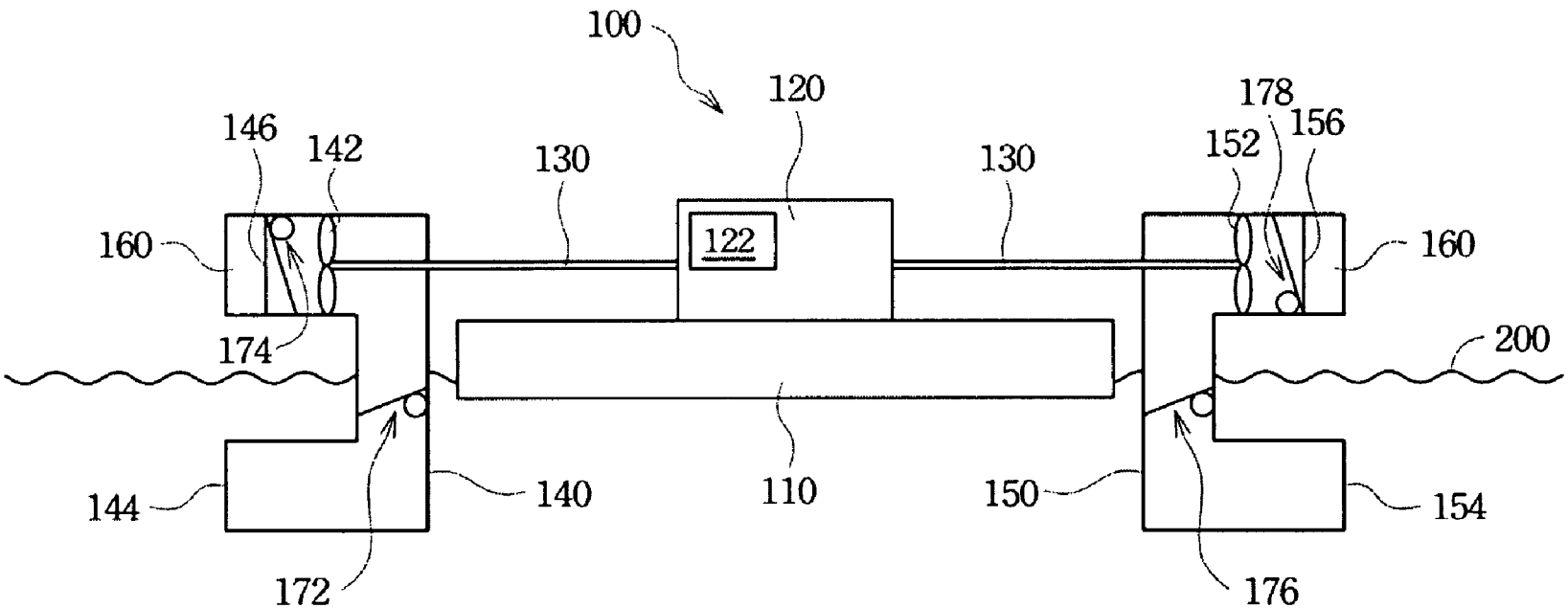
FIG. 4 is a schematic diagram of a fourth embodiment of the cruising aerator of the invention.

Refer to FIG. 4. FIG. 4 illustrates a schematic diagram of a fourth embodiment of the cruising aerator of the invention. The motor 120 of the cruising aerator 100 is disposed above the water surface 200. The first outlet 146 and the second outlet 156 are arranged above the water surface 200, and purposely-arranged to face in opposite directions.

The cruising aerator 100 further includes plural one-way check valves 172, 174, 176, and 178. The check valves 172 and 174 are implemented between the first inlet 144 and the first outlet 146. The check valves 176 and 178 are implemented between the second inlet 154 and the second outlet 156. The aerating nozzles 160 are disposed at the first outlet 146 and the second outlet 156.

The check valves 172 and 174 control the water flow passing through the first inlet 144 without back flow and store water within the first chamber 140 especially when the first impeller 142 rotates reversely (i.e. the motor 120 rotates counterclockwise). Consequently, the check valves 172 and 174 can prevent the air entering the first chamber 140 and pump cavitations due to large suction height.

By the same principle, the check valves 176 and 178 control the water flow passing through the second inlet 154 without back flow and store water within the second chamber 150 especially when the second impeller 152 rotates reversely (i.e. the motor 120 rotates clockwise). Consequently, a general motor is sufficient for the invention of this embodiment since it is disposed above the water surface although a submerged or water-proof motor can reduce the risk of short circuit.

Figure 5:
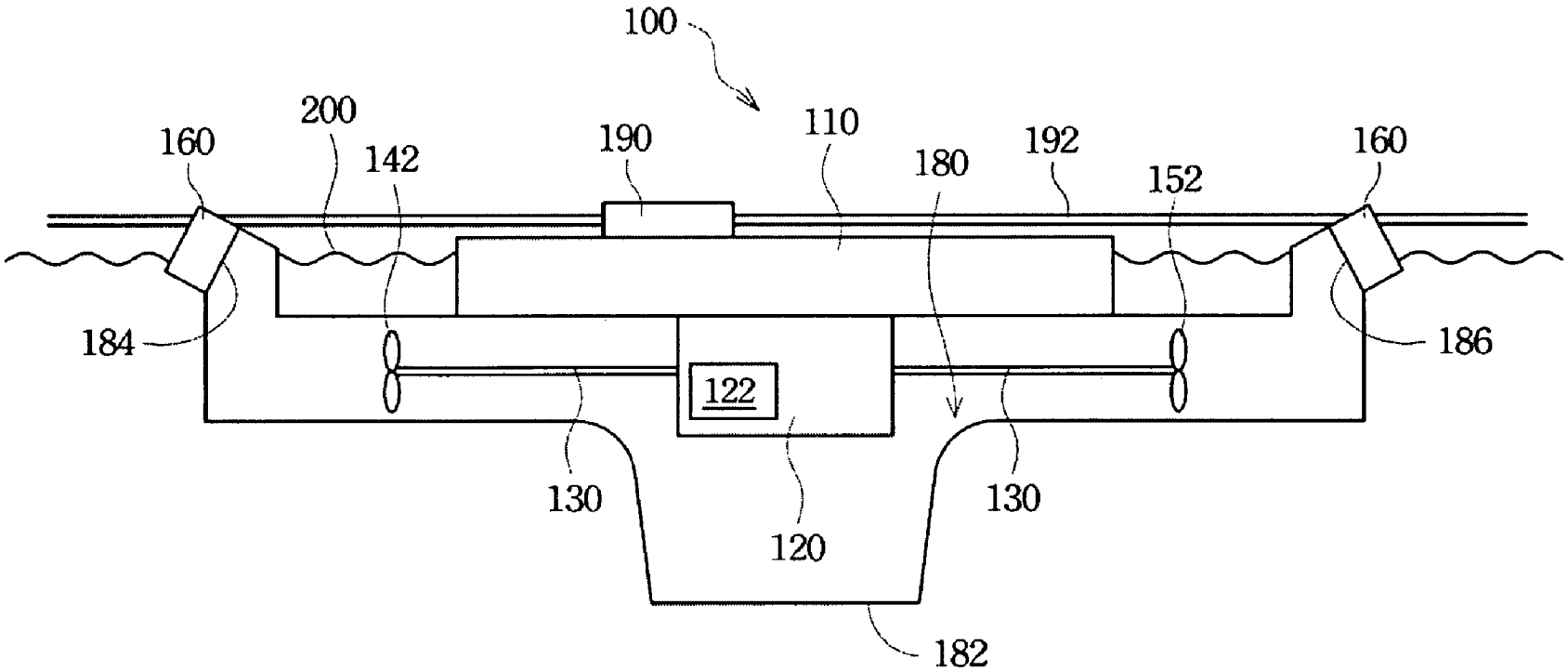
FIG. 5 is a schematic diagram of a fifth embodiment of the cruising aerator of the invention.

Refer to FIG. 5. FIG. 5 illustrates a schematic diagram of a fifth embodiment of the cruising aerator of the invention The cruising aerator 100 includes a common chamber 180 disposed under the raft 110. The motor 120, the shaft 130, the first impeller 142, and the second impeller 152 are installed inside of the common chamber 180. The common chamber 180 includes a common inlet 182, a first outlet 184, and a second outlet 186. The common inlet 182 is arranged under the water surface 200. The first outlet 184 and second outlet 186 are disposed corresponding to the first impeller 142 and second impeller 152, respectively, and are purposely-arranged to face in opposite directions. The first impeller 142 and the second impeller 152 rotate in opposite directions to each other.

When the motor 120 rotates clockwise, the first impeller 142 and the shaft 130 rotate clockwise, which rotates normally according to the assembly direction, and water is pumped into the common chamber 180 via the common inlet 182 and is ejected through the first outlet 184. The ejected water jets generate a counter-force to propel the cruising aerator 100 itself toward the direction of the second outlet 186.

When the motor 120 rotates counterclockwise, by the same principle, the second impeller 152 rotates counterclockwise, which rotates normally according to the assembly direction, and water is ejected through the second outlet 184. The ejected water jets generate a counter-force to propel the cruising aerator 100 itself toward the direction of the first outlet 184.

The cruising aerator 100 may be fitted with two aeration nozzles 160 disposed on the first outlet 184 and the second outlet 186. The water jets ejected from the aerating nozzle 160 are subsequently atomized into many small droplets to increase aeration efficiency due to the increase in water/air contact surface area, the duration of droplet suspension in the air, and spraying distribution range.

The cruising aerator 100 may further include the first and second one-way bearings (not shown). The first one-way bearing connects the shaft 130 and the first impeller 142. The second one-way bearing connects the shaft 130 and the second impeller 152. The two one-way bearings rotate in opposite directions, similar to FIG. 3. As a result, when motor 120 rotates either clockwise or counterclockwise, only one of the first and second impeller, which rotates normally would rotate, and the other impeller stay still to save power consumption.

The cruising aerator 100 can employ a sequential controller 122 for controlling the motor 120 to rotate clockwise or counterclockwise and a guiding device (not shown) so as to form an automatic back-and-forth cruising motion on the water surface 200 of a large pool. Consequently, the cruising direction, distance, route, and power switching duration of the cruising aerator 100 are regulated by controlling the direction of rotation and duration of operation of the motor 120 and altering the location of the rope of the guiding device.

Figure 6:
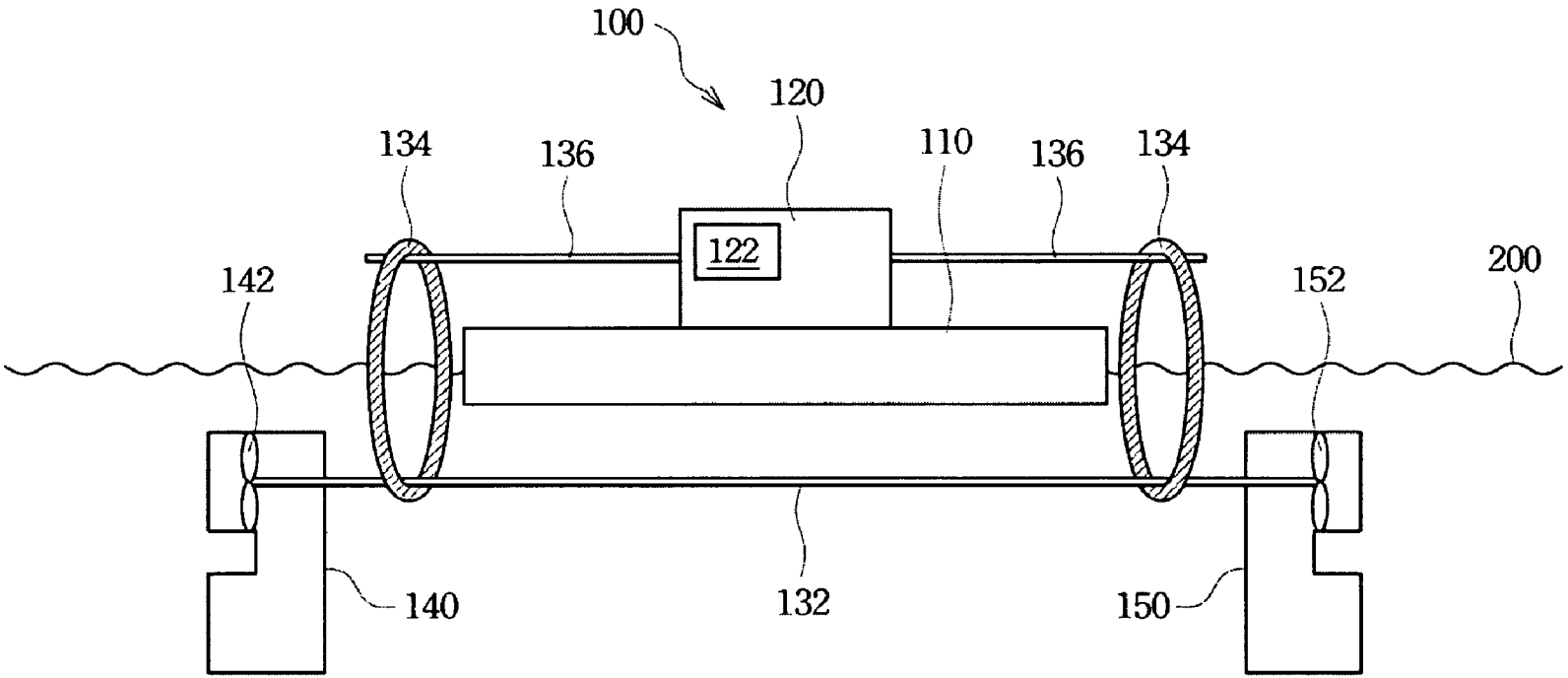
FIG. 6 is a schematic diagram of a sixth embodiment of the cruising aerator of the invention.

Refer to FIG. 6. FIG. 6 illustrates a schematic diagram of a sixth embodiment of the cruising aerator of the invention. The cruising aerator 100 includes a raft 110, a motor 120, a first shaft 136, a second shaft 132, a drive chain 134, a first chamber 140 with a first impeller 142, and a second chamber 150 with a second impeller 152. A general motor is sufficient for the invention since the motor 120 is disposed above the water surface although a submerged or water-proof motor can reduce the risk of short circuit.

The first shaft 136 is directly driven by the motor 120 and disposed above the water surface 200. The second shaft 132 is disposed under the water surface 200. The drive chain 134 links the first shaft 136 and the second shaft 132, thus the second shaft 132 can also be driven by the motor 120.

The first impeller 142 is mounted on the first end of the second shaft 132 and is installed in the first chamber. The second impeller is mounted on the second end of the second shaft 132 and is installed in the second chamber. The first impeller 142 and the second impeller 152 are purposely-arranged to rotate in opposite directions to each other, and are mounted on two opposite sides of the second shaft 132, driven by the motor 120 via the drive chain 134 and the first shaft 136.

Both the first chamber 140 and the second chamber 150 have upper openings and lower openings. The first chamber 140 associated with the first impeller 142 and the second chamber 150 associated with the second impeller 152 can be regarded as pumping devices. Each of the pumping devices can be used to pump water from the lower opening (deep region, lower water layer) to the upper opening (water surface, upper layer) or from the upper to the lower openings according to the assembly of pumping devices.

For example, when the motor 120 rotates clockwise, the first shaft 136 and the second shaft 132 are rotated clockwise. The first impeller 142 rotates clockwise, which rotates normally according to the assembly direction, but the second impeller 152 rotates reversely according to the assembly direction. Consequently, the water jets of large flow rates and strong momentum ejected from the first chamber 140 can propel the cruising aerator 100 toward the side of the second chamber 150.

When the motor 120 rotates counterclockwise, the first shaft 136 and the second shaft 132 are rotated counterclockwise. The first impeller 142 also rotates counterclockwise, which rotates normally according to the assembly direction, but the second impeller 152 rotates reversely according to the assembly direction. By utilizing the same principle, the strong water jets ejected from the second chamber 150 can propel the cruising aerator 100 toward the side of the first chamber 140.

In summary, FIG. 6 shows a schematic diagram of a sixth embodiment of the invention to aerate pool water either pumping water from water surface (upper layer) to the deep region (lower layer) or from the lower layer to upper layer according to the assembly of the first impeller 142 and the second impeller 152. The description of the use of a sequential controller 122 and guiding device (not shown) is well described in previous paragraphs and is, therefore, not repeated in this section.

Figure 7:
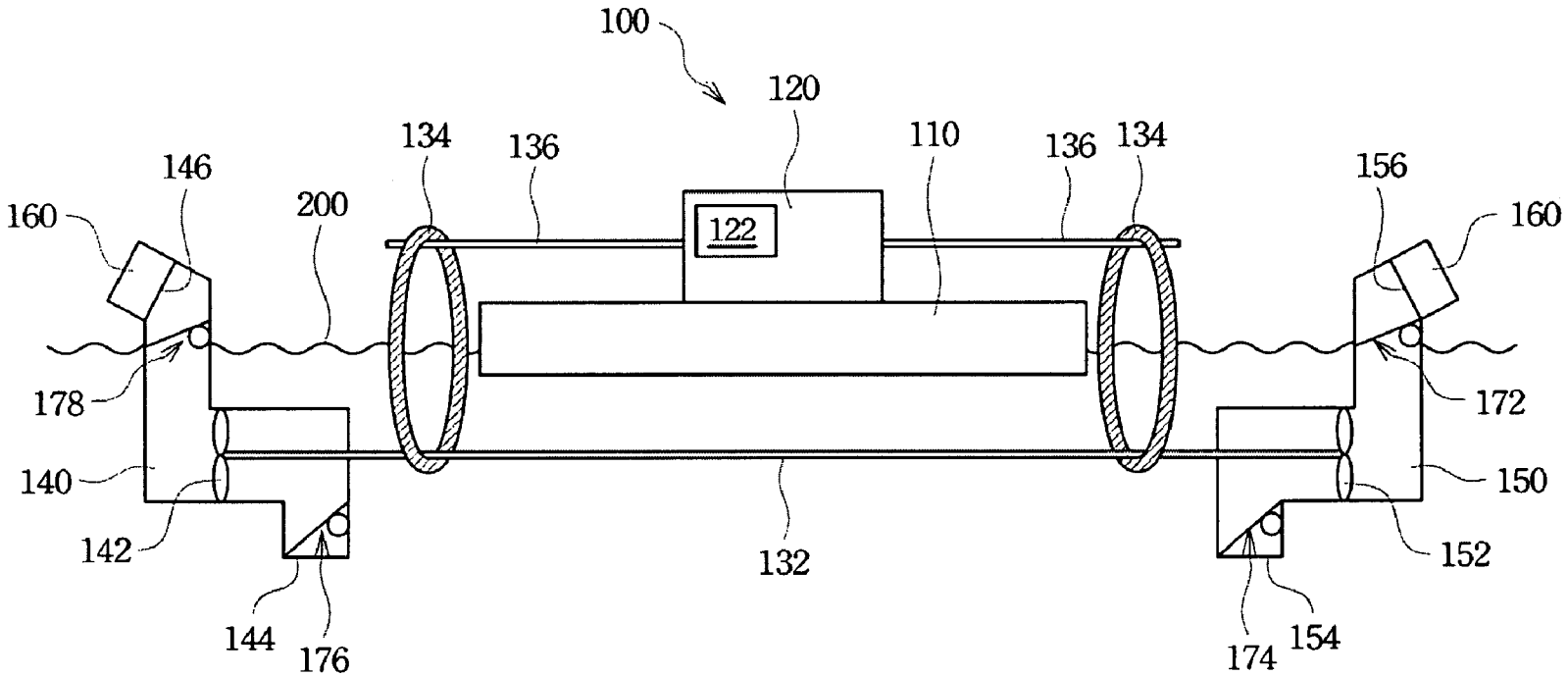
FIG. 7 is a schematic diagram of a seventh embodiment of the cruising aerator of the invention.

Refer to FIG. 7. FIG. 7 illustrates a schematic diagram of a seventh embodiment of the cruising aerator of the invention. The cruising aerator 100 includes a raft 110, a motor 120, a first shaft 136, a second shaft 132, a drive chain 134, a first chamber 140 with a first impeller 142, and a second chamber 150 with a second impeller 152, nozzles 160 and plural check valves 172, 174, 176, and 178. The motor 120 of the cruising aerator 100 for the embodiment is a general motor and is disposed above the water surface 200.

The first shaft 136 is disposed above the water surface 200 and driven by the motor 120. The second shaft 132 is disposed under the water surface 200, and also driven by the motor 120 via the drive chain 134 and the first shaft 136.

The first chamber 140 associated with the first impeller 142 and the second chamber 150 associated with the second impeller 152 can be regarded as pumping devices respectively. The first outlet 146 of the first chamber 140 and the second outlet 156 of the second chamber 150 are purposely-arranged to face in opposite directions above the water surface 200. The nozzles 160 are disposed on the first outlet 146 and the second outlet 156 to enhance aeration efficiency.

For the first chamber 140 and the first impeller 142, the one-way check valves 176 and 178 control the water flow passing through the first inlet 144 and the first outlet 146 and keep the water within the first chamber 140 to prevent backflow when the first impeller 142 rotates in the opposite direction to the original assembly direction.

For the second chamber 150 and the second impeller 152, the one-way check valves 172 and 174 control the water flow passing through the second inlet 154 and the second outlet 156 and keep the water within the second chamber 150 to prevent backflow when the second impeller 142 rotates in the opposite direction to the original assembly direction.

Consequently, the check valves 172, 174, 176, and 178 can further prevent suction since the air cannot enter the first chamber 140 or the second chamber 150. The other characteristics and functions of the seventh embodiment are similar to the sixth embodiment, and is, therefore, not repeated in this section.

Figure 8:
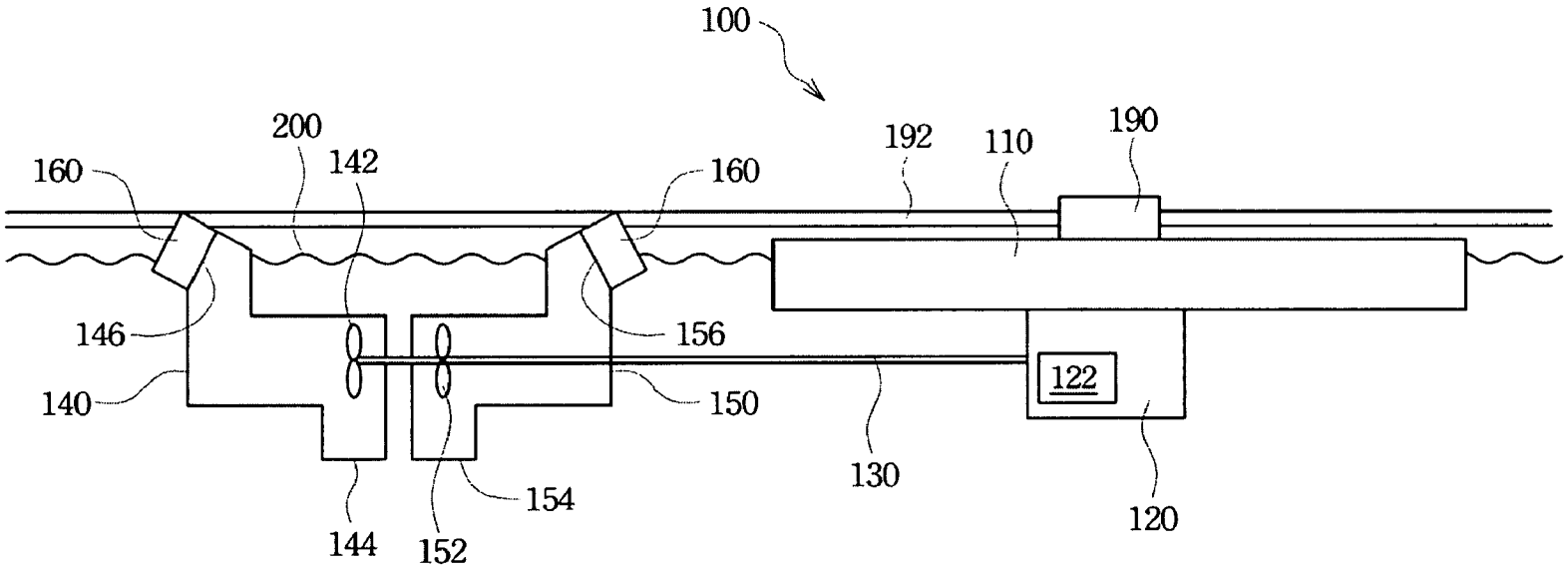
FIG. 8 is a schematic diagram of an eighth embodiment of the cruising aerator of the invention.

Refer to FIG. 8. FIG. 8 illustrates a schematic diagram of the eighth embodiment of the cruising aerator of the invention. The raft 110 floats on the water surface 200. The motor 120 of the cruising aerator 100 is a submerged motor, mounted on the lower side of the raft, under the water surface 200.

The shaft 130 is directly connected to the motor 120, and is also under the water surface 200. The first chamber 140 associated with the first impeller 142 and the second chamber 150 and the second impeller 152 can be regarded as pumping devices respectively. The pumping devices are arranged at the same side of the shaft 130 and under the water surface 200, and can either pump water from the upper opening (upper layer) to the lower layer (lower layer) or from the lower layer to upper layer according to the assembly of the pumping devices.

The first impeller 142 is mounted at one end of the shaft 130, and the second impeller 152 is mounted between the first impeller 142 and the motor 120. The first impeller 142 and the second impeller 152 are purposely-arranged to rotate in opposite directions to each other. The first outlet 146 of the first chamber 140 and the second outlet 156 of the second chamber 150 are side openings, and purposely-arranged to face in opposite directions.

For example, when the motor 120 rotates clockwise, the first impeller 142 arranged in the shaft 130 is rotated clockwise, which rotates normally according to the assembly direction, but the second impeller 152 is rotated reversely according to the assembly direction. The water flow can enter the first chamber 140 via the first inlet 144 and be ejected from the first outlet 146. The ejected water jets generate a counter-force, which propels the cruising aerator 100 toward the side of the second chamber 150.

When the motor 120 rotates counterclockwise, the first impeller 142 arranged in the shaft 130 is rotated counterclockwise, which rotates reversely according to the assembly direction, but the second impeller 152 is rotated normally. The water flow can enter the second chamber 150 via the second inlet 154 and be ejected from the second outlet 156. By the same principle, the ejected water jets generate a counter-force, which propels the cruising aerator 100 toward the side of the first chamber 140.

The aerating nozzles 160 are disposed on the first outlet 146 and the second outlet 156 to atomize the ejected water jets into many fine droplets thus increasing the water/air contact surface area by reducing droplet size, and the duration of droplet suspension time in the air.

The cruising aerator 100 can form an automatic back-and-forth cruising motion on the water surface 200 by the sequential controller 122 and the guiding device. The sequential controller 122 can control the direction of rotation and duration of operation of the motor 120, and, therefore, regulates the cruising direction, distance, and power switching duration of the cruising aerator 100. The guiding device includes the pipe 190, which is disposed on the raft 110, and the guiding rope 192, which is set over the water surface 200 and passes through the pipe 190. The route of the cruising aerator 100 in the pool can be changed by altering the locations of guiding rope 192.

In addition, the cruising aerator disclosed in above embodiment can induce a vertical convection flow for a wide area by pumping water between the upper and lower water layers together with an automatic cruising motion. This results in an increase in the aeration efficiency of the pool water, an increase in the effective range of algae's photosynthesis, and enlarges dissolved oxygen concentration in the pool bottom. The description of these effects on the ecological equilibrium, and the health of aquatic animals is well described in previous paragraphs and is, therefore, not repeated in this section.

The cruising aerator 100 can further employ plural check valves (not shown) disposed in the first chamber 140 and the second chamber 150. The one-way check valves can keep the water within the first chamber 140 and the second chamber 150 when the first impeller 142 or the second impeller 152 is rotated in the opposite direction. As a result, the check valves can prevent pump cavitation due to large suction height since air cannot enter the first chamber 140 or the second chamber 150.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cruising aerator comprising:

a raft;

a motor mounted on the raft;

a sequential controller connected to the motor for controlling the motor to rotate clockwise or counterclockwise;

a shaft having a first end and a second end and driven by the motor;

a first impeller mounted on the first end of the shaft;

a second impeller mounted on the second end of the shaft; and a common chamber having a first outlet corresponding to the first impeller, a second outlet corresponding to the second impeller, and a common inlet disposed under a water surface, wherein the motor, the shaft, the first impeller, and the second impeller are installed inside of the common chamber, wherein the first outlet and the second outlet are arranged to face in opposite directions, and the first impeller and the second impeller are assembled to have opposite normal rotating directions to each other according to a rotating direction of the motor.

2. The cruising aerator of claim 1, further comprising two aeration nozzles disposed on the first outlet and the second outlet respectively.

3. The cruising aerator of claim 1, further comprising the two one-way bearings rotating in opposite directions, disposed on the shaft, between the first impeller and the second impeller respectively.

4. The cruising aerator of claim 1, further comprising a pipe disposed on the raft and a guiding rope set over the water surface and passing through the pipe.

5. A cruising aerator comprising:

a raft;

a motor mounted on the raft;

a sequential controller connected to the motor for controlling the motor to rotate clockwise or counterclockwise;

a shaft driven by the motor;

a first chamber having a first outlet and a first inlet;

a first impeller mounted on the shaft and installed inside of the first chamber;

a second chamber having a second outlet and a second inlet; and a second impeller mounted on the shaft and installed inside of the second chamber, wherein the first outlet and the second outlet are arranged to face in opposite directions, and the first impeller and the second impeller are assembled to have opposite normal rotating directions to each other according to a rotating direction of the motor.

6. The cruising aerator of claim 5, wherein the first chamber and impeller, and the second chamber and impeller are mounted on the same side of the shaft.

7. The cruising aerator of claim 5, wherein the first chamber and impeller and the second chamber and impeller are mounted on opposite sides of the shaft.

8. The cruising aerator of claim 5, wherein the shape of the first chamber and the second chamber is approximate to an inverted-L.

9. The cruising aerator of claim 5, wherein the shape of the first chamber and the second chamber is approximate to a lain-U.

10. The cruising aerator of claim 5, further comprising a plurality of check valves disposed in the first chamber and the second chamber.

11. The cruising aerator of claim 5, further comprising the two aeration nozzles disposed on the first outlet and the second outlet respectively.

12. The cruising aerator of claim 5, further comprising the two one-way bearings rotating in opposite directions, disposed on the shaft, between the first impeller and the second impeller, respectively.

13. The cruising aerator of claim 5, further comprising a pipe disposed on the raft and a guiding rope set over a water surface and passing through the pipe.

14. A cruising aerator comprising:

a raft;

a motor mounted on the raft;

a sequential controller connected to the motor for controlling the motor to rotate clockwise or counterclockwise;

a first shaft driven by the motor;

a second shaft disposed under a water surface;

a drive chain linking the first shaft and the second shaft;

a first chamber mounted on the second shaft and having a first outlet and a first inlet;

a first impeller mounted on the second shaft and installed inside the first chamber;

a second chamber mounted on the second shaft and having a second outlet and a second inlet; and a second impeller mounted on the second shaft and installed inside the second chamber, wherein the first outlet and the second outlet are arranged to face in opposite directions, and the first impeller and the second impeller are assembled to have opposite normal rotating directions to each other according to a rotating direction of the motor.

15. The cruising aerator of claim 14, wherein the first chamber and impeller, and the second chamber and impeller are mounted on the same side of the shaft.

16. The cruising aerator of claim 14, wherein the first chamber and impeller and the second chamber and impeller are mounted on opposite sides of the shaft.

17. The cruising aerator of claim 14, further comprising a plurality of check valves disposed in the first chamber and the second chamber.

18. The cruising aerator of claim 14, further comprising the first and second aeration nozzles disposed on the first outlet and the second outlet respectively.

19. The cruising aerator of claim 14, further comprising the first and second one-way bearings rotating in opposite directions, disposed on the shaft, between the first impeller and the second impeller, respectively.

20. The cruising aerator of claim 14, further comprising a pipe disposed on the raft and a guiding rope set over the water surface and passing through the pipe.

* * * * *